US005511357A

United States Patent [19]

Ricketts et al.

[11] Patent Number: 5,511,357

[45] Date of Patent: Apr. 30, 1996

[54] APPARATUS FOR CONTROLLING THE POSITION OF AN ENVELOPE IN AN INSERTER MACHINE

[75] Inventors: David J. Ricketts, Essex; Keith J. Yates, Hertfordshire, both of England

[73] Assignee: Pitney Bowes plc, Harlow, England

[21] Appl. No.: 359,157

[22] Filed: Dec. 19, 1994

[51] Int. Cl.[6] ..... B65B 57/04; B65B 5/04; B65B 5/06

[52] U.S. Cl. ..... 53/55; 53/284.3; 53/569; 53/381.5; 53/377.6

[58] Field of Search ..... 53/284.3, 460, 53/201, 569, 64, 116, 117, 381.5, 381.6, 55, 377.6

[56] References Cited

U.S. PATENT DOCUMENTS

| | | | |
|---|---|---|---|
| 4,766,715 | 8/1988 | Dimur | 53/284.3 X |
| 4,852,334 | 8/1989 | Auerbach | 53/284.3 X |
| 5,255,498 | 10/1993 | Hotchkiss et al. | 53/284.3 X |
| 5,297,376 | 3/1994 | Taguchi et al. | 53/284.3 X |
| 5,406,771 | 4/1995 | Dronsfield | 53/284.3 X |
| 5,415,068 | 5/1995 | Marzullo | 53/284.3 X |
| 5,447,015 | 9/1995 | Belec et al. | 53/284.3 X |

*Primary Examiner*—Horace M. Culver
*Attorney, Agent, or Firm*—Charles R. Malandra, Jr.; Melvin J. Scolnick

[57] ABSTRACT

An inserter machine has means for feeding an envelope withdrawn from a storage tray to a flap device 44 capable of opening the envelope flap and forwarding the envelope along a deck 42 with its base edge leading and its open flap trailing. Encoder means 60, 108 are connected for rotation in synchronization with one or more rolls forming part of the forwarding means. The machine also has a means 80 for disconnecting drive to the envelope to stop the envelope at a stuffing station, and a wetter arrangement 116, 118 whereby the envelope flap can be wetted prior to sealing. An envelope stop 128 is provided in a flap closure mechanism 126, 120, 142; the stop being adjustable in position without operator intervention in response to information provided by the encoder means 66, 108 or by data fed in by a user via a keyboard on the machine.

8 Claims, 5 Drawing Sheets

APPARATUS FOR CONTROLLING THE POSITION OF AN ENVELOPE IN AN INSERTER MACHINE

BACKGROUND OF THE INVENTION

This invention relates to apparatus for controlling the position of an envelope in an inserter machine.

In U.S. Pat. No. 4,903,456 (Meur), there is disclosed a control device for controlling the advance and positioning of envelopes in an insertion machine. This control device includes a stepper motor which is connected both to a mechanism for transferring empty envelopes towards the insertion station and to a mechanism for transferring filled envelopes away from the insertion station so they can be ejected. A circuit is provided for controlling and governing the speed of the stepper motor. The stepper motor is driven on the basis of clock signals generated by a clock circuit synchronously with commands which are generated within the machine. The speed of the stepper motor is governed on the basis of a defined number of motor steps as detected, counting from the moment that an envelope ceases to go past an intermediate point on the transfer path. There is a detector at this intermediate point.

The present invention aims to provide a versatile and multi-featured inserter machine.

SUMMARY OF THE INVENTION

According to the present invention, there is provided an inserter machine comprising means for feeding an envelope withdrawn from a storage tray to a flap device capable of opening the envelope flap and forwarding the envelope along a deck with its base edge leading and its open flap trailing, encoder means connected for rotation in synchronisation with one or more rolls forming part of the forwarding means, the machine also having a means for disconnecting drive to the envelope to stop the envelope at a stuffing station, and a wetter arrangement whereby the envelope flap can be wetted prior to sealing, wherein an envelope stop is provided in an envelope flap closure mechanism, the stop being adjustable in position without operator intervention in response to information provided by the encoder means or by data fed into a keyboard on the machine.

According to an embodiment of the present invention, there is provided an apparatus for controlling the position of an envelope in an inserter machine, the apparatus comprising a motor driven roll for feeding an envelope withdrawn from a storage tray to a first driven pair of rolls and thence to a flap device arranged to open the envelope flap and forward the envelope along a deck with its base edge leading and its open flap trailing, an encoder connected for rotation in synchronization with the motor driven roll, a sensor arranged in the vicinity of the exit of the storage tray and capable of providing respective signals upon sensing the leading and trailing edges of the envelope, a second pair of rolls downstream of the first pair and arranged to drive lo the envelope to a third pair of rolls, the lower roll of the third pair being downwardly withdrawable to remove drive form the envelope in order to cause the envelope to halt, a second encoder arranged to be driven in synchronism with the first pair of rolls, and a control unit arranged to receive signals from the first and second encoders and, in response thereto, to activate a mechanism arranged to downwardly withdraw the said lower roll of the third pair whereby the envelope is brought to a halt at the desired halting point.

In a preferred embodiment of the invention, the said mechanism, when so activated, also causes one or more holding fingers to move downwardly so that its tip (or their tips) holds the envelope flap against the deck and hence securely holds the o envelope in a fixed position for insertion of the intended inserts.

DESCRIPTION OF THE DRAWINGS

FIG. 5 is provided so that the reader can readily understand the internal positioning of the portions of the machine shown in FIGS. 1, 3 and 4. In FIG. 5, the numeral 500 indicates the envelope tray and the arrangements for feeding envelopes therefrom, 502 and 504 indicate fold chutes, 506 indicates the envelope transport deck and stuffing station, and 508 indicates the envelope flap wetting arrangement and the envelope flap closure mechanism.

DESCRIPTION OF THE PREFERRED EMBODIMENTS

Figure 1:
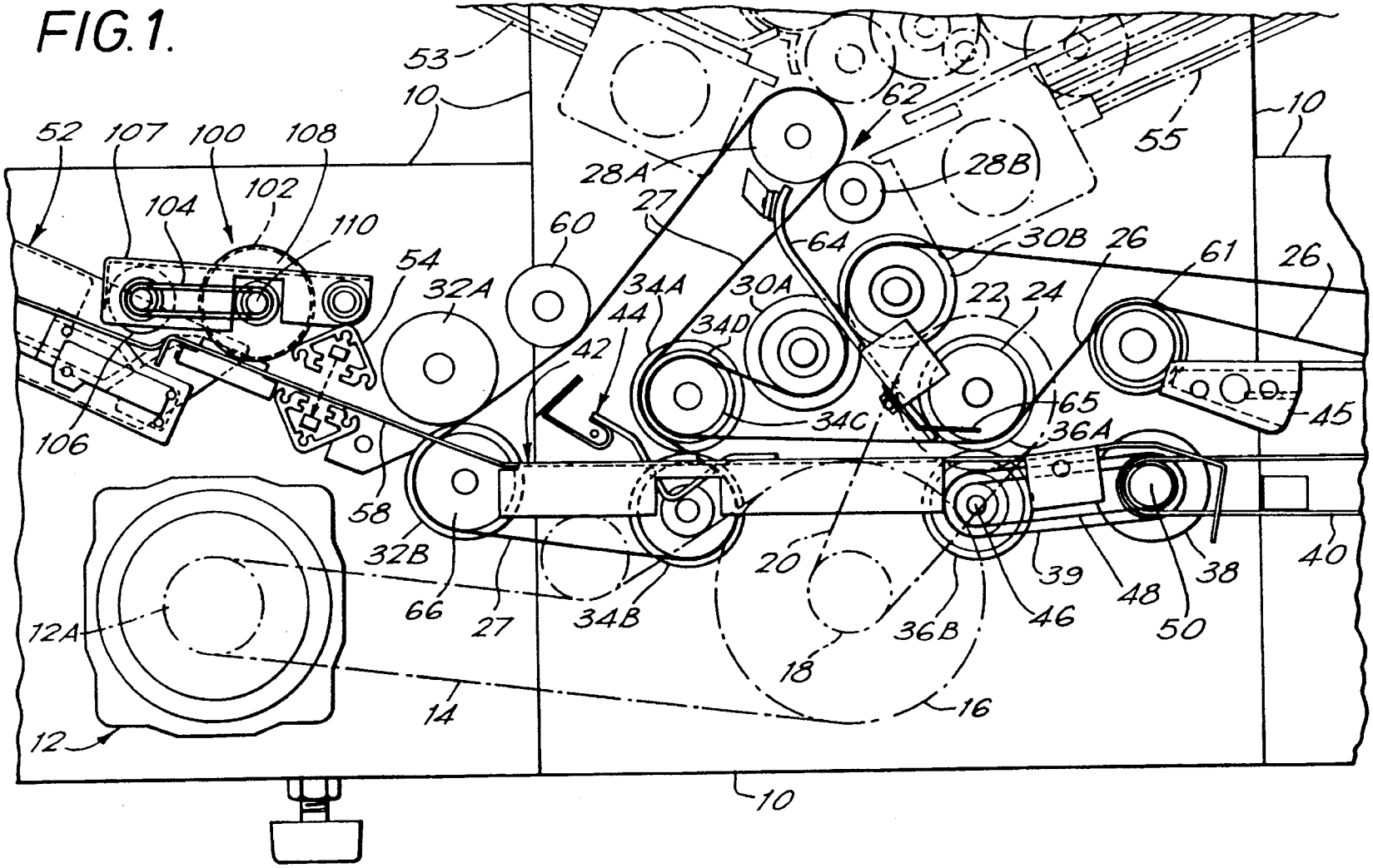
FIG. 1 is a diagrammatic side elevation (with the front casing removed) of one example of inserter machine embodying the present invention.

In FIG. 1 of the drawings, the machine casing is seen at 10. It contains an electric motor (an AC motor is preferred) 12. This electric motor drives a large diameter sprocket 16 by an endless belt 14. The belt 14 (and the belts 20, 26, 27, 39 and 40 mentioned below) are preferably ribbed so as to make good driving engagement o with the sprockets. Alternatively, chain and sprocket drives may be employed. An output sprocket 12A is mounted on the motor output shaft and the other end of the endless belt 14 extends around the large diameter sprocket 16. Fixed on the same shaft as the large diameter 16 is a smaller diameter sprocket 18, which drives a belt 20 which extends around an intermediate diameter sprocket 22. This sprocket is fixed to the same shaft as a small diameter sprocket 24, around which extends an endless belt 26. This belt 26 drives a sprocket 34 C which is fixed as the same shaft as the roll 34A (to be later described). Also fixed to the same shaft is a sprocket 34D which drives a further endless belt 27. The function of the belts 26 and 27 is to drive a number of pairs of rolls whose function is to forward inserts or envelopes, as the case may be, to the appropriate positions in the inserter machine. The belt 26 also causes an envelope closure mechanism to operate.

Figure 4:
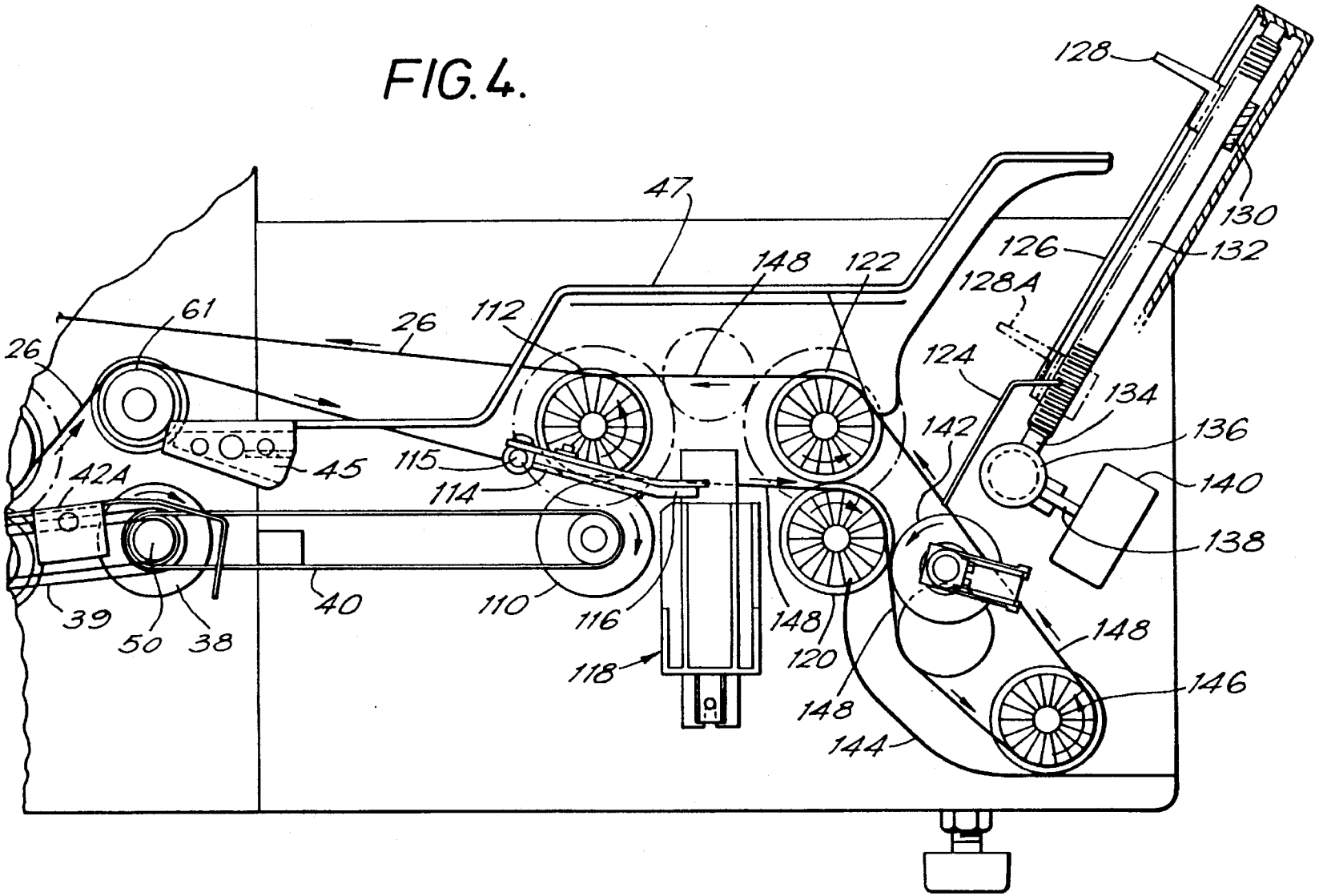
FIG. 4 illustrates an envelope closing and sealing assembly which includes a wetter arrangement.
Figure 5:
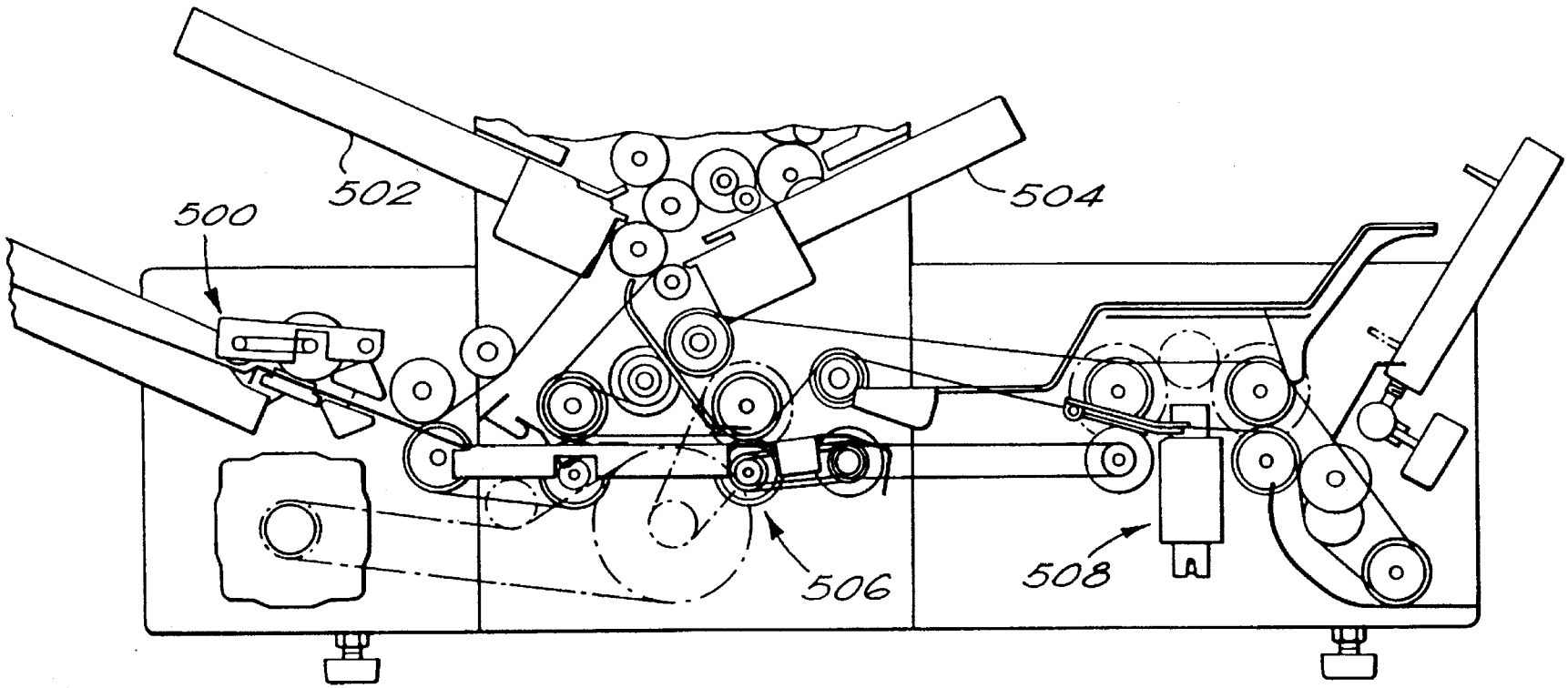
FIG. 5 is a diagrammatic side elevation showing the lower part of the inserter machine of FIGS. 1–4.

The belt 26 extends around, and provides drive to, rolls 30A, 30B, 34C and 36A, and 112, FIG. 4. The belt 27 is driven by a sprocket 34D on the same shaft as roll 34A and extends around, and provides drive to rolls 28A, 28B, 32B and 34B. Roll 32A is driven from the roll 32B. A further roll 38 is provided, driven from the roll 36B by an endless belt 39. Tensioning idlers 60 and 61 are provided to tension the belts 27 and 26 respectively.

Extending around a pair of sprockets on the same shaft 50 as the roll 38 is an endless belt 40, which serves in use as a take-away belt. Envelopes leaving the rolls 36A, 36B move over the upsloping deck portion 42A. A deflector 45 guides them down towards the belt 40. The deflector 45 is located on one end of a cover 47 over the wetter assembly. The belt 40 transports envelopes which have had one or more inserts 76 placed therein ("stuffed envelopes") away from the roll 38. They are transported towards an envelope wetting and closing arrangement which is shown in FIG. 4. The belt 40 is driven from a sprocket fixed to a shaft to which is fixed the roll 110; the roll 110 is in frictional engagement with, and driven by, the roll 112. Alternatively, the roll 110 may be driven by interengaging pinions respectively on the shafts of rolls 112 and 110, which are located in the wetter arrangement 508. The roll 112 drives, via an additional sprocket, a belt 148 which causes rotation of the rolls of the wetter as will be later described. As seen in FIG. 1, there is an envelope storage tray 52 at the fight hand end of which is an envelope feed mechanism 100 which will be described later. Fold chutes 502 and 504 are disposed on opposite sides of the insert feed path. Only part of these fold chutes are shown in FIG. 1. Their function is to fold inserts as may be desired. Since fold chutes as such are known, they need not be described further. Their manner of operation is substantially similar to that described in relation to fold chutes 30, 39, FIG. 2, in U.K. Patent No. 2,227,234. Slightly downstream (in the envelope travel direction, that is, towards the right as seen in the drawing) of the storage tray 52 is an opto-electronic sensor device 54 which may be a through beam device or a reflective device. In the drawing, the illustration of an arrow indicates a through beam device but a reflective device could equally well be employed. Extending from the feed tray 52 is a downwardly sloping deck 58 which merges into a flat deck 42. Just downstream of the rolls 32A and 32B is located an envelope flap-opening device 44. Flap opening devices for envelopes are known, and so further details of the device 44 are not provided in this specification, since the details of its design from no part of the novelty of the present invention.

After leaving the tray 52 the envelope is upstream of the device 44, and is being fed in a direction generally towards the right, with the base edge 70, FIGS. 2A–2D, of the envelope leading, and the envelope edge 74 trailing. The device 44 cooperates with rolls 32A, 32B to cause the traveling envelope, disposed transversely of the length of the deck 42, to adopt a slightly curved transverse "wave" shape facilitating opening of the flap 72 of the envelope. The flap edge is denoted by 72A.

Figure 2A:
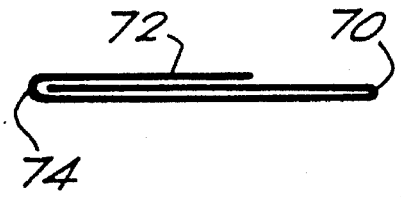
FIGS. 2A–2D illustrate an envelope.
Figure 2B:
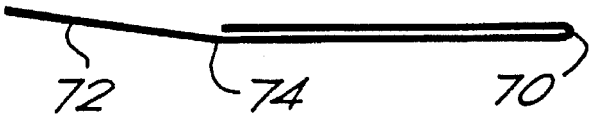
Figure 2C:
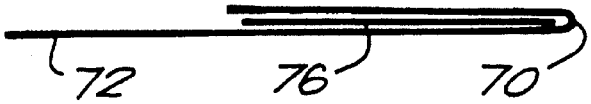
Figure 2D:
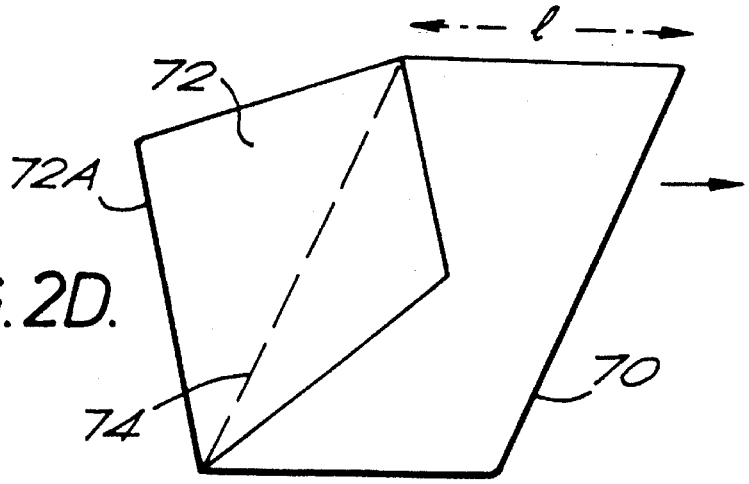

As the envelope passes the sensor 54, the sensor 54 generates a first and second signal, which are passed to the control of the machine which contains a CPU. These signals are generated when the leading edge 70 of the envelope passes the sensor 54 and when the trailing edge 74 (i.e. the fold between envelope base sheet and envelope flap, the envelope being in its flap folded-over condition, FIG. 2A, at this time) passes the sensor 54. For ease of understanding, the envelope configuration in the storage tray 52 (FIG. 2A), the configuration as it passes the sensor 54 (also FIG. 2A), the configuration after it has passed the flap opener 44 (FIG. 2B), and the configuration after it has been stuffed with the insert 76 and has left the rolls 36A, 36B, FIG. 2C, are all illustrated in diagrammatic FIG. 2.

The desired halt position for the envelope is determined by the machine configuration and is in the region of confluence of a guide 64 and the deck 42. The envelope, whatever its length, has to be halted such that its throat (fold line 74) is at a predetermined position in relation to the means for feeding inserts which are to be inserted into the envelope. Such inserts are fed in the direction of the arrow 62, passed through the rolls 28A, 28B, 30A, 30B and are fed along the guide 64. Spring fingers 65, located laterally of the machine hold up the descending insert so that it (the insert) contacts the roll 36A and continues to be driven into the open envelope throat and thus fully into the envelope. An encoder 66 is mounted to be driven in synchronization with the rotation of the roll 32B; it may, for example be fixed to the output shaft of the motor 12.

Figure 3:
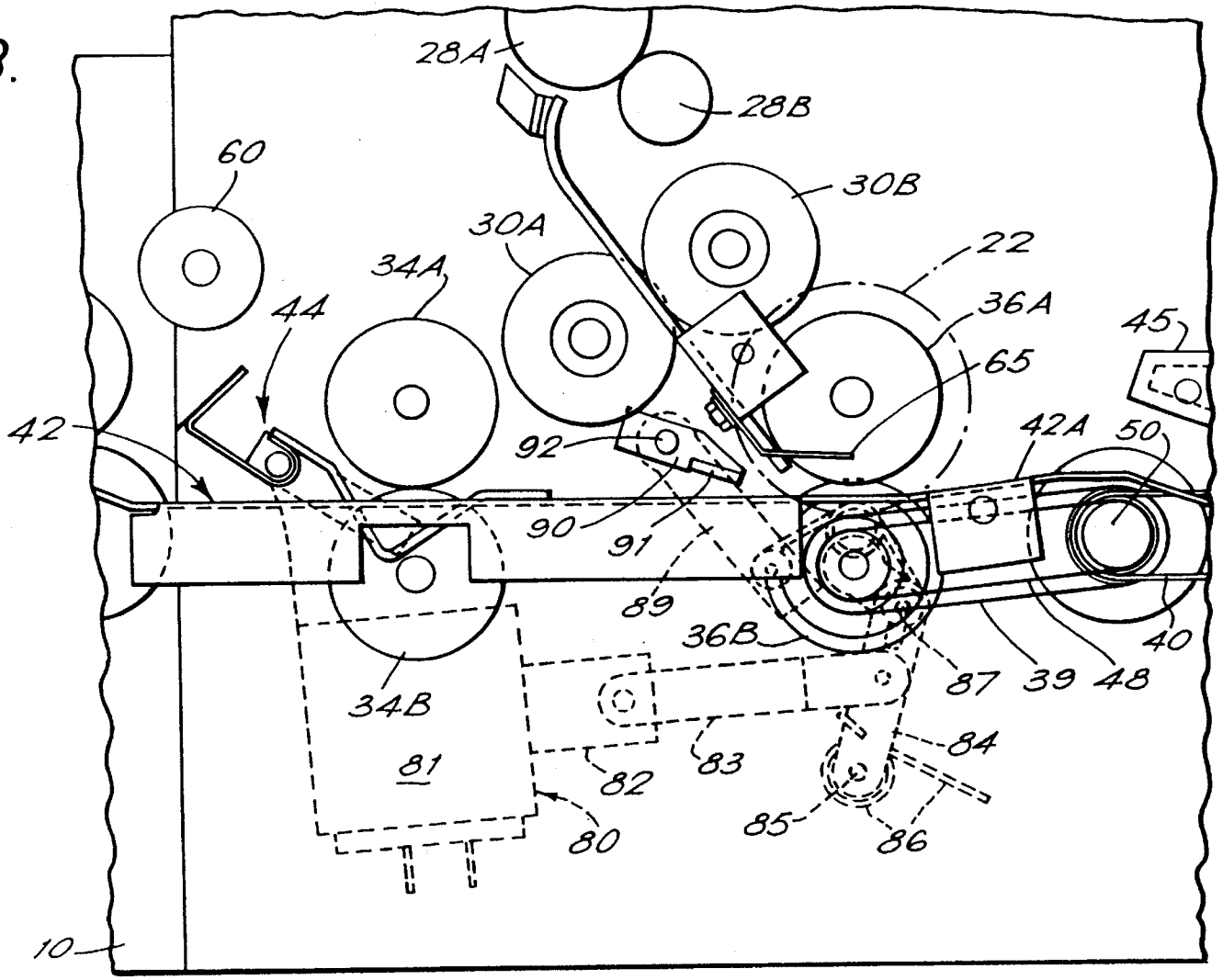
FIG. 3 illustrates a portion of the inserter machine shown in FIG. 1, and shows a solenoid mechanism which causes a downward movement of the roll 36B and the stop finger 90 at the appropriate time.

The roll 36B is mounted on a shaft 46 which can rotate within suitable bearings. An eccentric arrangement supports the shaft 46 whereby the roll 36B can be shifted downwardly when desired. A solenoid mechanism 80, shown in FIG. 3, is provided for rotating the eccentric arrangement at the desired moment when it is sought to halt the envelope's rightward movement. As seen in FIG. 3, a solenoid 81 has an armature 82 which is pivotally connected by a link 83 to a pivotable arm 84, rotatable about a shaft 85 attached to a suitable fixed point in the machine. A wrap spring 86 provides for return action, i.e. ensuring the armature pulls out fully when the solenoid is deenergised. The free end of the arm is attached by a pivot 87 to the eccentric arrangement. In use, energisation of the solenoid 81 causes the arm 84 to move about its pivot 85 in an counter-clockwise direction, so pulling the roll 36B downward, and thus removing drive from the envelope. The solenoid mechanism 80 operates under the control of the CPU. At the same time, a link 89, connected to the eccentric arrangement, is pivoted so causing one or more envelope flap grips fingers 90 to be pivoted clockwise about the pivot axis 92. A rubber or like pad 91 on the or each finger 90 engages and grips the envelope flap which at that time is open and trailing. In this way the envelope is properly held at the stuffing station. The finger 90 serves to temporarily prevent the envelope being pushed towards the right when the insert is inserted thereinto. For a fuller description of how the drive is re-activated once the envelope is stuffed, the reader is referred to our U.K Patent No. 2,227,234. The stuffed envelope is moved away downstream onto the take away belt 40.

The envelope feed tray 52 has a feed arrangement 100 which comprises a DC motor 102, arranged to drive a belt 104 which in turn drives a roll 106 having a frictional surface, e.g. soft rubber, for engaging the uppermost envelope in the tray. The roll 106 is carried on a pivotable bracket 107. An encoder 108 is mounted on the output shaft of the motor 102. Alternatively, the encoder 108 may be mounted elsewhere, provided it is driven in synchronization with motor 102. In the illustrated arrangement, the motor 102 is disposed behind the bracket 107. The arrangement 100 also has a device for preventing "double feed" i e. the simultaneous feeding of two envelopes. This device includes an upwardly-sprung pad disposed directly beneath separating rolls (not shown) which are rotatable with shaft 111 and located at spaced intervals thereon.

In use, the sensor 54 provides respective signals as the envelope leading edge 70 and the trailing edge 74 pass the sensor 54. The passage of the trailing edge 74 is used, in conjunction with the encoders 66 and 108, in positioning the envelope at its "stuffing" position. The generation of the two signals is also used for two other purposed, that is, to detect "stream feeding" from the tray 52 and to check for any envelope flaps which may have been prematurely opened and which would give problems, in that the open flap trailing edge (72A, FIG. 2) would be interpreted (incorrectly) as the trailing edge 74 giving the result that the envelope would be wrongly positioned at the stuffing station.

The encoder 108 (which is preferable fixed to the shaft 111 which may be the output drive shaft of the motor 102)

generates pulses which are fed to the CPU. Alternatively, however, the encoder 108 could be driven indirectly from the motor 102, e.g. by gearing. The shaft 111 carries, spaced along its length, a plurality of separating rollers which in use engage the top envelope of the stack. Envelope length "1" is determined in the following way. The sensor 54 senses the envelope leading edge 70 following which the envelope continues to advance, driven by the roll 106 and the separating rolls on the shaft 111. After a fixed number "n" of pulses, the envelope leading edge 70 reaches the nip of rolls 32A, 32B. Once this occurs, the movement of the envelope continues, driven by the rolls 32A, 32B, and the pulses generated by encoder 66 are counted until the sensor 54 senses the trailing edge 74 of the envelope. At this time "m" assume pulses have been generated by encoder 66. Envelope length in millimeters then equals

[(millimeters per pulse of encoder 108)×n]+

[(millimeters per pulse of encoder 66×m)].

Of course the distance along the envelope path from the nip of rolls 32A, 32B to the stuffing station is fixed by the machine design and is known.

Provision is made in the machine for the operator to adjust the envelope position (either upstream or downstream but not laterally) at the stuffing station. This adjustment may be required in certain circumstances. Such an adjustment may for example be required when thick packets or bundles of inserts are to be inserted in the envelope. For example, if a relatively thick insert packet were to be inserted in an envelope, then it would be desirable to bring the envelope to a halt a short distance downstream of the normal halt position at the stuffing station. The operator feeds in via a keyboard on the machine, in suitable length units, the desired difference, either positive (downstream) or negative (upstream) between the normal envelope position at the stuffing station and the desired envelope position in the region of the stuffing station. This infeed by the operator is fed through to the CPU which adjusts the number of encoder pulses from encoder 66 which are allowed to elapse before the solenoid mechanism is triggered. The keyboard (not shown) may be located on, and supported by, the frame 10.

Reference was made above to the prevention of "stream feeding" of envelopes. As will be understood, stream feeding occurs when two or more envelops overlap and become temporarily stuck together. Since the envelope length is known, and the pulses from the encoder 66 occur at a defined rate, stream feeding is detected by the fact that the number of pulses counted between the leading edge of the first of the stream of overlapped envelopes being sensed by the sensor 54 and the trailing edge of the last of the overlapped envelopes being so sensed exceeds the number of pulses counted (in normal operation) between the leading and trailing edges of a single envelope being sensed. When such an increased number of pulses is recognized by the CPU, the CPU shuts off the machine.

Reference was also made above to the detection of open-flapped envelopes. These produce the same effect as described above, that is, the number of pulses received by the CPU in the period between sensing of leading edge 70 (FIG. 2) and sensing of the trailing edge 72A of the flap is greater if the envelope flap is open than in the normal case wherein the leading and trailing edges 70 and 74 are sensed. Once the CPU recognizes this excess of pulses, the machine is switched off The machine includes a further useful feature. It is undesirable for the DC motor 102 to run continuously. Since the generation rate of pulses is constant, it is possible to determine the number of pulses (×) occurring between the leading edge 70 of the envelopes being sensed by sensor 54 and entering the nip between the rolls 32A, 2B. The CPU is programmed to switch off the motor 102, × pulses after the sensing of the leading edge 70. This method of switching off the motor 102 has the advantage that it works satisfactorily independently of envelope length 1. It ensures that the motor 102 is switched off once the envelope is safely under control of the rolls 32A, 32B.

The wetter and envelope flap closure arrangements will now be described with reference to FIG. 4. The wetter includes a pair of rolls 110, 112, whose nip receives the stuffed envelope. The envelope flap is then still open and trailing. A guide plate 114, bearing a wetter pad 116 at its free end, guides the envelope over a reservoir 118. The plate 114 is pivotally attached at 115 to a suitable fixed point in the machine. The structure and operation of these pans can be better understood from our U.K. Patent No. 2,227,234, see FIGS. 13 and 14 thereof and the associated description. The guide plate 114 is normally held by a suitable mechanism, under control of the CPU, in a lifted position which allows the envelops to pass under it. At the appropriate time, determined by a sensor, not shown, in the wetter assembly, which senses passage of an envelope, the wetter pad is lowered onto the adhesive-carrying portion of the envelope flap.

The envelope, with flap wetted, is then in the nip of rolls 120, 122 and is driven by them to a ramp 124 which guides it onto a ramp 126. Longitudinally slidable along the ramp 126 is an envelope stop 128, seen in dotted outline 128A in a possible alternative position suitable for short envelopes. The stop 128 has a threaded collar 130 thereon, within which runs a leadscrew 132, rotatable by shaft 134. The shaft 134 is driven via a bevel gear 136 from an output shaft 138 of a motor 140. The latter is under control of the CPU which has stored therein information on the length of the envelope, obtained as described above. The motor 140 is controlled by the CPU to drive the stop 128 to a position appropriate to the length of the envelope. The stop must be positioned so that, when the leading edge 70 of the envelope hits the stop, its trailing edge 74 has left the nip of the rolls 120/122. After hitting the stop 128, the envelope falls under gravity and enters the nip between rolls 120 and 142. As the envelope falls, its flap is partly open and is, for example, at an angle of about 15° to about 80° to the remainder of the envelope. It descends into the nip 120/142 with its edge 74 leading. Its passage through the rolls 120 and 142 firmly closes the flap. The pressure applied by the rolls 120, 142 sticks the flap down tightly onto the envelope rear surface. The position of the envelope stop 128 may be determined according to one option in relation of the envelope length, or it may be determined according to another option in relation to the so-called "panel length" that is, the length of panel of the insert that is to be placed in the envelope. For example, a sheet inserter of A4 size has a height of 30 cms. and a width of 21 cms. If z-folded to have two fold lines 10 and 20 cms. from the tope edge, the panel length of such a folded insert would be 10 cms. If however folded once in half and then in half again, its panel length would be 7½ cms. In use, the operator of the machine specifies the desired panel length by inputting the appropriate value to a memory in the CPU via the keyboard of the machine. The user of the machine can specify via the keyboard which option he or she wants, and the CPU then takes either the information on envelope length or on panel length from its memory and appropriately instructs the motor 140 to position the stop 128 a distance away from the nip 120/122 which slightly exceeds (e.g. by a few millimeters) the envelope length 1 or, in the panel length option, a distance away from the nip 120/122 which exceeds the panel length plus a predetermined amount, which may/br example be a few millimeters. This avoids any possibility (a common problem with operator-adjusted stops) that the positioning of the stop 128 is inappropriate for the envelope being used or for the panel length of the chosen insert. The sealed envelopes leaving the rolls 120, 142 are guided by a guide plate 144 and ejected from the machine by a driven friction roll 146. This roll 146 is driven by an endless ribbed belt 148.

It will be appreciated that modifications can be made to the apparatus disclosed and illustrated herein, without departing from the invention.

We claim:

1. An inserter machine comprising means for feeding an envelope withdrawn from a storage tray to a flap device capable of opening the envelope flap and forwarding the envelope along a deck with its base edge leading and its open flap trailing, encoder means connected for rotation in synchronization with one or more rolls forming part of the forwarding means, the machine also having a means for disconnecting drive to the envelope to stop the envelope at a stuffing station, and a wetter arrangement whereby the envelope flap can be wetted prior to sealing and flap closure, wherein an envelope stop is provided in a flap closure mechanism, the stop being adjustable in position without operator intervention in response to information provided by the encoder means or by data fed into a keyboard on the machine.

2. A machine according to claim 1 further comprising a motor driven leadscrew arrangement for adjusting the position of the envelope stop longitudinally of an upwardly-extending ramp.

3. A machine according to claim 2 in which an opto-electronic sensor device is located adjacent to and downstream of an envelope feed mechanism located on a lower end of an envelope storage tray.

4. A machine according to claim 2 in which said lead-screw drive motor is a D.C. motor.

5. An apparatus for controlling the position of an envelope in an inserter machine, the apparatus comprising a motor driven roll for feeding an envelope withdrawn from a storage tray to a first driven pair of rolls and thence to a flap device arranged to open the envelope flap and forward the envelope along a deck with its base edge leading and its open flap trailing, an encoder connected for rotation in synchronization with the motor driven roll, a sensor arranged in the vicinity of the exit of the storage tray and capable of providing respective signals upon sensing the leading and trailing edges of the envelope, a second pair of rolls downstream of the first pair and arranged to drive the envelope to a third pair of rolls, the lower roll of the third pair being downwardly withdrawable to remove drive from the envelope in order to cause the envelope to halt, a second encoder arranged to be driven in synchronism with the first pair of rolls, and a control unit arranged to receive signals from the first and second encoders and, in response thereto, to activate a mechanism arranged to downwardly withdraw the said lower roll of the third pair whereby the envelope is brought to a halt at the desired halting point.

6. An apparatus according to claim 5 in which the said mechanism when so activated, also causes one or more holding fingers to move downwardly so that its tip (or their tips) holds the envelope flap against the deck and hence securely holds the envelope in a fixed position for insertion of the intended inserts.

7. A machine according to claim 5 in which an opto-electronic sensor device is located adjacent to and downstream of an envelope feed mechanism located on a lower end of an envelope storage tray.

8. An apparatus according to claim 5 or any claim dependent thereon in which an A.C. motor is arranged to drive the first pair of rolls and the motor which is arranged to drive the said motor driven roll is a D.C. motor.

* * * * *